US008350168B2

(12) United States Patent
Faik

(10) Patent No.: US 8,350,168 B2
(45) Date of Patent: Jan. 8, 2013

(54) QUAD BREAK MODULAR CIRCUIT BREAKER INTERRUPTER

(75) Inventor: Salaheddine Faik, Marion, IA (US)

(73) Assignee: Schneider Electric USA, Inc., Palatine, IL (US)

( * ) Notice: Subject to any disclaimer, the term of this patent is extended or adjusted under 35 U.S.C. 154(b) by 290 days.

(21) Appl. No.: 12/827,689

(22) Filed: Jun. 30, 2010

(65) Prior Publication Data

US 2012/0000753 A1 Jan. 5, 2012

(51) Int. Cl.
*H01H 1/22* (2006.01)

(52) U.S. Cl. ..... 200/244; 335/16

(58) Field of Classification Search ..... 200/244, 200/400, 11 J, 243, 248; 218/22; 335/16, 335/147, 195
See application file for complete search history.

(56) References Cited

U.S. PATENT DOCUMENTS

| | | | | |
|---|---|---|---|---|
| 3,177,332 | A | | 4/1965 | Bethke |
| 4,482,877 | A | * | 11/1984 | Castonguay et al. ..... 335/191 |
| 4,649,247 | A | | 3/1987 | Preuss et al. |
| 4,910,485 | A | | 3/1990 | Bolongeat-Mobleu et al. |
| 5,023,416 | A | * | 6/1991 | Oyama et al. ..... 200/244 |
| 5,029,301 | A | | 7/1991 | Nebon et al. |
| 5,030,804 | A | | 7/1991 | Abri |
| 5,281,776 | A | | 1/1994 | Morel et al. |
| 5,298,874 | A | | 3/1994 | Morel et al. |
| 5,310,971 | A | | 5/1994 | Vial et al. |
| 5,313,180 | A | | 5/1994 | Vial et al. |
| 5,363,076 | A | * | 11/1994 | Miller et al. ..... 335/16 |
| 5,534,832 | A | | 7/1996 | Duchemin et al. ..... 335/16 |
| 5,539,167 | A | * | 7/1996 | Hood et al. ..... 200/244 |
| 6,037,555 | A | | 3/2000 | Castonguay et al. |
| 6,087,609 | A | | 7/2000 | Thilker et al. |
| 6,087,913 | A | | 7/2000 | Castonguay et al. |
| 6,114,641 | A | | 9/2000 | Castonguay et al. |
| 6,166,344 | A | | 12/2000 | Castonguay et al. |
| 6,172,584 | B1 | | 1/2001 | Castonguay et al. |
| 6,175,288 | B1 | | 1/2001 | Castonguay et al. |
| 6,184,761 | B1 | | 2/2001 | Doma et al. |
| 6,188,036 | B1 | | 2/2001 | Arnold |
| 6,204,743 | B1 | | 3/2001 | Greenberg et al. |
| 6,211,757 | B1 | | 4/2001 | Castonguay et al. |
| 6,211,758 | B1 | | 4/2001 | Castonguay et al. |
| 6,215,379 | B1 | | 4/2001 | O'Keefe et al. |
| 6,218,917 | B1 | | 4/2001 | Criniti et al. |

(Continued)

FOREIGN PATENT DOCUMENTS

DE 2 845 950 4/1980

(Continued)

OTHER PUBLICATIONS

International Search Report, PCT/US2011/042263, Dated Sep. 14, 2011, 5 pages.

(Continued)

*Primary Examiner* — Xuong Chung Trans
(74) *Attorney, Agent, or Firm* — Nixon Peabody LLP

(57) ABSTRACT

An interrupter includes at least four pairs of contacts. Each pair of contacts includes a stationary contact positioned to abut a corresponding moveable contact. The moveable contacts are coupled to a rotating member. The rotating member is coupled to a driving member via a biasing member. The driving member is rotated causing all four pairs of contacts to separate and open a circuit quickly.

23 Claims, 4 Drawing Sheets

U.S. PATENT DOCUMENTS 6,218,919 B1 4/2001 Ciarcia et al.
6,222,139 B1 4/2001 Pandit et al.
6,225,881 B1 5/2001 Felden et al.
6,229,413 B1 5/2001 Castonguay et al.
6,232,570 B1 5/2001 Castonguay et al.
6,232,856 B1 5/2001 Boucher et al.
6,232,859 B1 5/2001 Christensen et al.
6,239,395 B1 5/2001 Rosen
6,239,398 B1 5/2001 Doughty et al.
6,239,677 B1 5/2001 Ramakrishnan et al.
6,252,365 B1 6/2001 Morris et al.
6,259,048 B1 7/2001 Castonguay et al.
6,262,642 B1 7/2001 Bauer
6,262,872 B1 7/2001 Messerli et al.
6,268,991 B1 7/2001 Criniti et al.
6,281,458 B1 8/2001 Castonguay et al.
6,281,461 B1 8/2001 Doughty
6,300,586 B1 10/2001 Doughty et al.
6,310,307 B1 10/2001 Ciarcia et al.
6,313,425 B1 11/2001 Doughty et al.
6,317,018 B1 11/2001 Castonguay et al.
6,326,868 B1 12/2001 Kranz et al.
6,326,869 B1 12/2001 Felden et al.
6,340,925 B1 1/2002 Castonguay et al.
6,346,868 B1 2/2002 Castonguay et al.
6,346,869 B1 2/2002 Marple et al.
6,362,711 B1 3/2002 Larranaga et al.
6,366,188 B1 4/2002 Hein et al.
6,366,438 B1 4/2002 Bauer
6,373,010 B1 4/2002 Narayanan et al.
6,373,357 B1 4/2002 Douville et al.
6,377,144 B1 4/2002 Castonguay et al.
6,379,196 B1 4/2002 Greenberg et al.
6,380,829 B1 4/2002 Castonguay et al.
6,388,213 B1 5/2002 Letient et al.
6,388,547 B1 5/2002 Castonguay et al.
6,396,369 B1 5/2002 Schlitz et al.
6,400,245 B1 6/2002 Castonguay et al.
6,400,543 B2 6/2002 Messerli et al.
6,403,901 B1 6/2002 Boeder et al.
6,404,314 B1 6/2002 Arnold et al.
6,421,217 B1 7/2002 Castonguay et al.
6,429,659 B1 8/2002 Marple et al.
6,429,759 B1 8/2002 Schlitz et al.
6,429,760 B1 8/2002 Greenberg et al.
6,448,521 B1 9/2002 Castonguay et al.
6,448,522 B1 9/2002 Rosen et al.
6,459,059 B1 10/2002 Greenberg et al.
6,459,349 B1 10/2002 Giday et al.
6,466,117 B2 10/2002 Castonguay et al.
6,469,882 B1 10/2002 Tignor
6,472,620 B2 10/2002 Rane et al.
6,476,335 B2 11/2002 Letient
6,476,337 B2 11/2002 Castonguay et al.
6,476,698 B1 11/2002 Anand et al.
6,479,774 B1 11/2002 Castonguay et al.
6,496,347 B1 12/2002 Christensen et al.
6,531,941 B1 3/2003 Greenberg et al.
6,534,991 B2 3/2003 Marple et al.
6,559,743 B2 5/2003 Narayanan et al.
6,586,693 B2 7/2003 Castonguay
6,590,173 B2 7/2003 Uchida et al.
6,590,482 B2 7/2003 Castonguay et al.
6,639,168 B1 10/2003 Castonguay et al.
6,678,135 B2 1/2004 Tignor et al.
6,710,988 B1 3/2004 Yee et al.
6,724,286 B2 4/2004 Arnold et al.
6,747,535 B2 6/2004 Castonguay et al.
6,804,101 B2 10/2004 Tignor et al.
6,806,800 B1 10/2004 Castonguay et al.
6,870,112 B2 3/2005 Bresciani et al.
6,882,258 B2 4/2005 Castonguay et al.
6,919,785 B2 7/2005 Douville et al.
6,924,445 B2 8/2005 Bresciani et al.
6,965,292 B2 11/2005 Ciarcia et al.
6,995,640 B2 2/2006 Harmon et al.
7,005,594 B2 2/2006 Kim
7,116,194 B2 10/2006 Azzola et al.
7,189,935 B1 3/2007 Hassan et al.
7,221,246 B2 5/2007 Rajauria et al.
7,301,742 B2 11/2007 Tignor et al.
7,394,032 B2 7/2008 Handler et al.
7,728,247 B2 6/2010 Pikkala et al.
7,800,007 B2 * 9/2010 Soundararajan et al. ..... 200/400
8,089,016 B2 * 1/2012 Dahl et al. ..... 200/400

FOREIGN PATENT DOCUMENTS

DE 29709759 10/1998
DE 10 2006 016273 10/2007
EP 0 174 904 3/1986
EP 1085542 3/2001
GB 785874 11/1957

OTHER PUBLICATIONS

International Written Opinion, PCT/US2011/042263, Dated Sep. 14, 2011, 7 pages.

* cited by examiner

QUAD BREAK MODULAR CIRCUIT BREAKER INTERRUPTER

FIELD OF THE INVENTION

The present invention relates generally to circuit breakers and, more particularly, to modular circuit breakers with one modular interrupter per phase of electricity.

BACKGROUND OF THE INVENTION

The internal design of a circuit breaker's interrupter defines its performance. Two characteristics used to measure a circuit breaker's performance include the peak current (Ip) and the energy integral ($I^2t$). Designing a circuit breaker that minimizes these quantities is desirable to increase performance and lower the interruption time, which may increase the longevity of the circuit breaker among other benefits.

A first type of prior art circuit breaker includes one pair of contacts including a moveable contact attached to an arm that pivots about a fixed point and a fixed contact attached to a terminal of the circuit breaker. The contact pair remains pressed together until the circuit breaker trips, which causes the pair of contacts to physically separate, thereby breaking the flow of current therethrough. This first type of tripping mechanism is slow and not suitable for high-performance interruption.

A second type of prior art circuit breaker includes a rotating blade operating two pairs of contacts. A more complete description of the second type of prior art circuit breaker can be found in U.S. Pat. No. 4,910,485 to Mobleu et al. While the second type of prior art circuit breaker has a better interruption performance as compared to the first type with a single contact pair, a rotating blade operating two contact pairs is limited in its interruption performance. Specifically, to increase the interruption performance of such a circuit breaker, the rotating blade radius can be increased, which results in a sharp increase in the inertia of the moveable blade—as the inertia of the blade is proportional to the square of its radius. This sharp increase in inertia is disadvantageous as the necessary force to move the blade from a closed position to a tripped position is also sharply increased, which can result in a longer amount of time to interrupt the circuit.

Thus, a need exists for an improved apparatus. The present invention is directed to satisfying one or more of these needs and solving other problems.

SUMMARY OF THE INVENTION

The present disclosure provides an interrupter for a circuit breaker having an increased interruption speed, i.e., the flow of electricity through the circuit breaker is interrupted in a shorter amount of time as compared to prior interrupters. The disclosed interrupter includes at least four pairs of contacts, a rotating member, and a driving member. The interrupter unit is configured to increase interruption speed with a linear increase of inertia by keeping a radius of the rotating member constant. The inclusion of 4, 6, 8 or more pairs of contacts according to the disclosed circuit breaker design increases the interruption speed, which is advantageous as a faster interruption speed may result in a more robust and longer lasting circuit breaker.

The foregoing and additional aspects and embodiments of the present invention will be apparent to those of ordinary skill in the art in view of the detailed description of various embodiments and/or aspects, which is made with reference to the drawings, a brief description of which is provided next.

BRIEF DESCRIPTION OF THE DRAWINGS

The foregoing and other advantages of the invention will become apparent upon reading the following detailed description and upon reference to the drawings.

DETAILED DESCRIPTION OF THE ILLUSTRATED EMBODIMENTS

Although the invention will be described in connection with certain aspects and/or embodiments, it will be understood that the invention is not limited to those particular aspects and/or embodiments. On the contrary, the invention is intended to cover all alternatives, modifications, and equivalent arrangements as may be included within the spirit and scope of the invention as defined by the appended claims.

Figure 1:
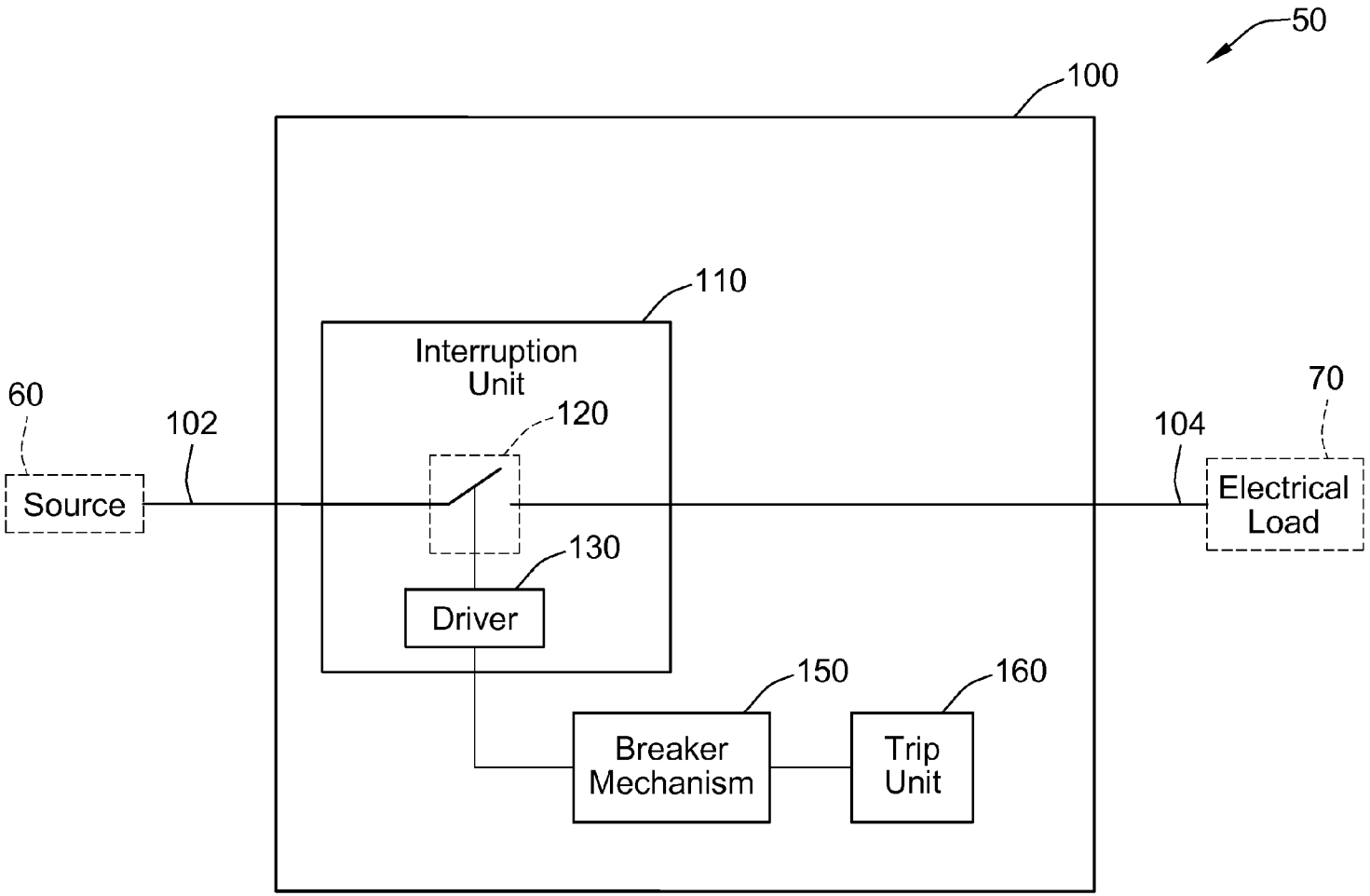
FIG. 1 is a functional block diagram of a circuit breaker having an interruption unit in a circuit according to some aspects of the present disclosure.

Referring to FIG. 1, a functional block diagram of a circuit 50 including a circuit breaker 100 is shown. The circuit breaker 100 includes an interruption unit 110, a breaker mechanism 150, and a trip unit 160. The circuit breaker 100 is configured to handle between 0 and 760 volts. Other voltages are contemplated, such as, for example, between 0 and 1000 volts. The interruption unit 110 includes a rotary arm assembly 120 and a driving member or driver 130. Electricity can be conducted along the circuit 50 and through the circuit breaker 100 via a line terminal 102, through the interruption unit 110, and exiting a load terminal 104. The line terminal 102 can be electrically coupled to an electrical source 60, such as, for example, a power utility, an electrical generator, or the like. The load terminal 104 can be electrically coupled to an electrical load 70, such as, for example, a light fixture, a motor, an appliance, etc.

The trip unit 160 is configured to monitor the circuit 50 for undesired fault conditions and to cause a chain reaction of mechanical actions, which interrupts the circuit 50 in response to detecting a fault condition. Fault conditions may include, for example, arc faults, overloads, ground faults, and short-circuits. In response to detecting a fault condition, the trip unit 160 releases the breaker mechanism 150, which frees the breaker mechanism 150 to act on the interruption unit 110. The breaker mechanism 150 can include, for example, a bimetal mechanism, a magnetic armature mechanism, an electronic or electro-magnetic mechanism, or a combination thereof. As explained herein in further detail, the breaker mechanism 150 is configured to switch the driving member 130 of the interruption unit 110 from a closed position to a tripped position, which in the process of switching causes the rotary arm assembly 120 to rotate. The rotation of the rotary arm assembly 120 separates four pairs of contacts 127*a-d* (FIG. 2A-C), which interrupts the circuit 50.

Figure 2A:
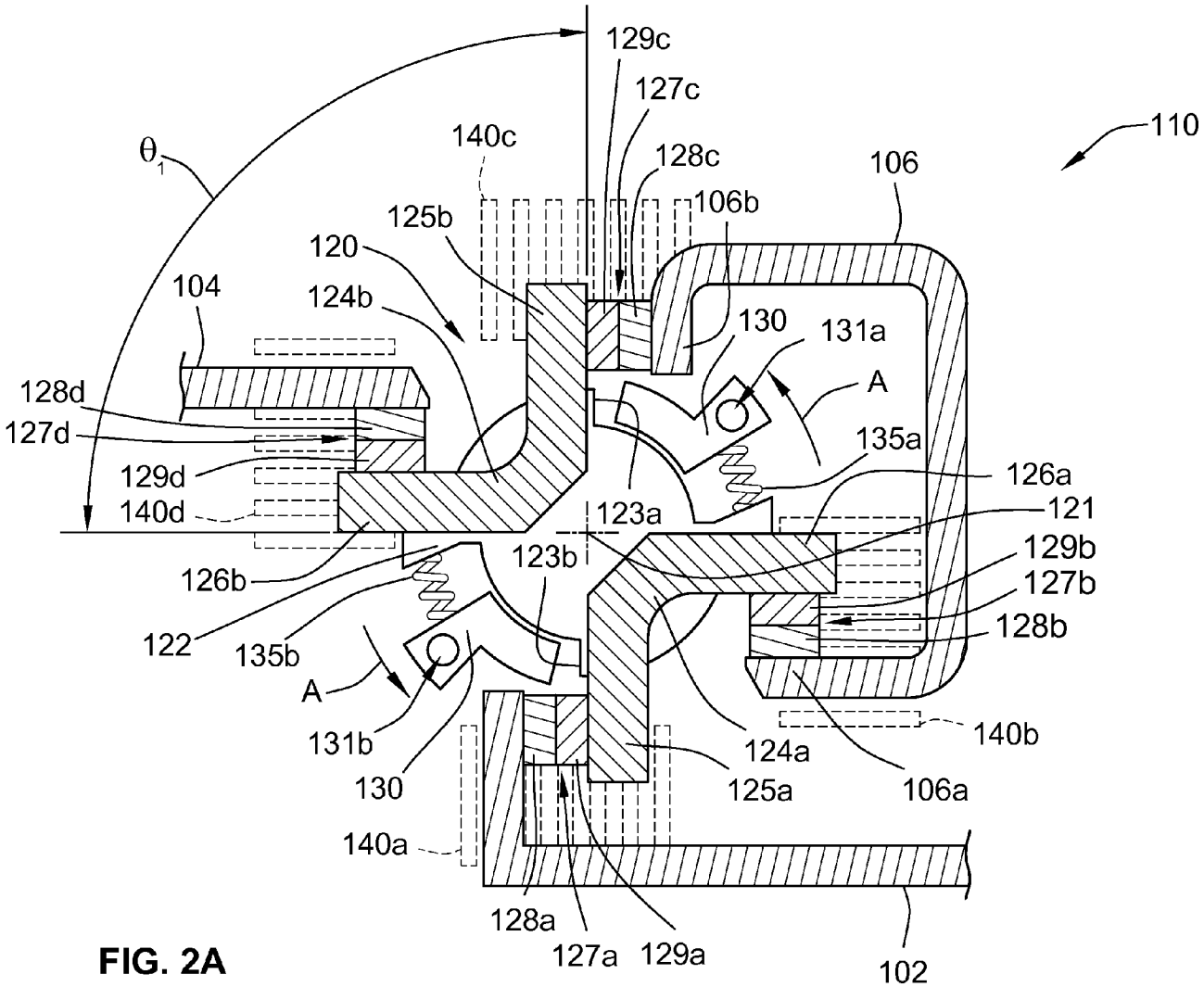
FIG. 2A is a plan view of the interruption unit of FIG. 1 in a closed position.

Referring to FIG. 2A, the interruption unit 110 is shown in a closed position. In the closed position, current is free to flow in the circuit 50 through the interruption unit 110 to the electrical load 70, that is, the circuit 50 is closed. The interruption unit 110 includes the rotary arm assembly 120, the driving member 130, and the four pairs of contacts 127*a-d*.

Each of the first through fourth pairs of contacts 127*a-d* includes a stationary contact 128*a-d* and a corresponding moveable contact 129*a-d*. Specifically, the first stationary contact 128*a* and the first moveable contact 129*a* form the first pair of contacts 127*a*. Similarly, the second stationary contact 128*b* and the second moveable contact 129*b* form the second pair of contacts 127*b*, the third stationary contact 128*c* and the third moveable contact 129*c* form the third pair of contacts 127*c*, and the fourth stationary contact 128*d* and the fourth moveable contact 129*d* form the fourth pair of contacts 127*d*.

The first stationary contact 128*a* is coupled to or integral with the line terminal 102 such that the first stationary contact 128*a* is configured to be electrically connectable to the first moveable contact 129*a*. The second stationary contact 128*b* is coupled to, or integral with, a first end 106*a* of an intermediate terminal 106 such that the second stationary contact 128*b* is configured to be electrically connectable to the second moveable contact 129*b*. The third stationary contact 128*c* is coupled to or integral with a second end 106*b* of the intermediate terminal 106 such that the third stationary contact 128*c* is configured to be electrically connectable to the third moveable contact 129*c*. The fourth stationary contact 128*d* is coupled to or integral with the load terminal 104 such that the fourth stationary contact 128*d* is configured to be electrically connectable to the fourth moveable contact 129*d*. The stationary contacts 128*a-d* if desired can be made of the same conductive material as the terminals 102, 104, 106. The stationary contacts 128*a-d* are generally fixed relative to an outer housing (not shown) of the interruption unit 110 as known in the art.

The rotary arm assembly 120 includes a rotating member 122 and two electrically conducting arms 124*a,b*. The rotating member 122 can be of any shape or form that rotates about an axis. As shown in FIG. 2A, the rotating member 122 is in a closed position where each of the moveable contacts 129*a-d* substantially touches a respective one of the stationary contacts 128*a-d*. The rotating member 122 is illustrated as having a generally barrel shape that rotates about its central axis 121. The rotating member 122 can be made of any electrically insulating material, such as, for example, plastic, rubber, non-conducting metals, etc. The rotating member 122 includes two lips or surfaces 123*a,b* positioned to be engaged by the driving member 130. As illustrated in FIG. 2C, the driving member 130 is configured to engage one or more of the lips 123*a,b* to cause the rotary arm assembly 120 to rotate in the direction of arrow A. The lips 123*a,b* are formed in the rotating member 122 such that movement of the driving member 130 causes rotation of the rotating member 122 about its central axis 121.

Figure 2B:
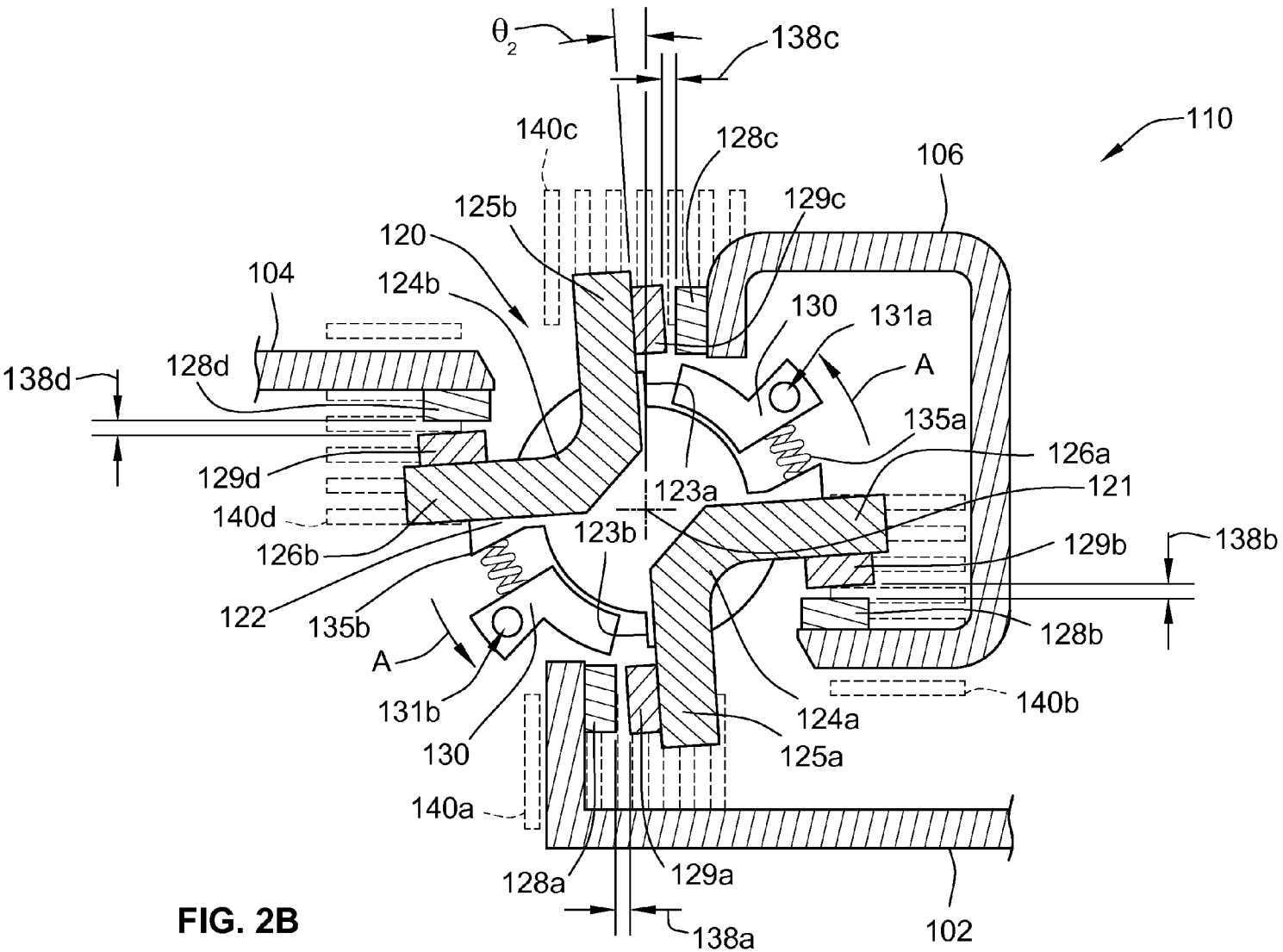
FIG. 2B is a plan view of the interruption unit of FIG. 1 in an intermediate position.
Figure 2C:
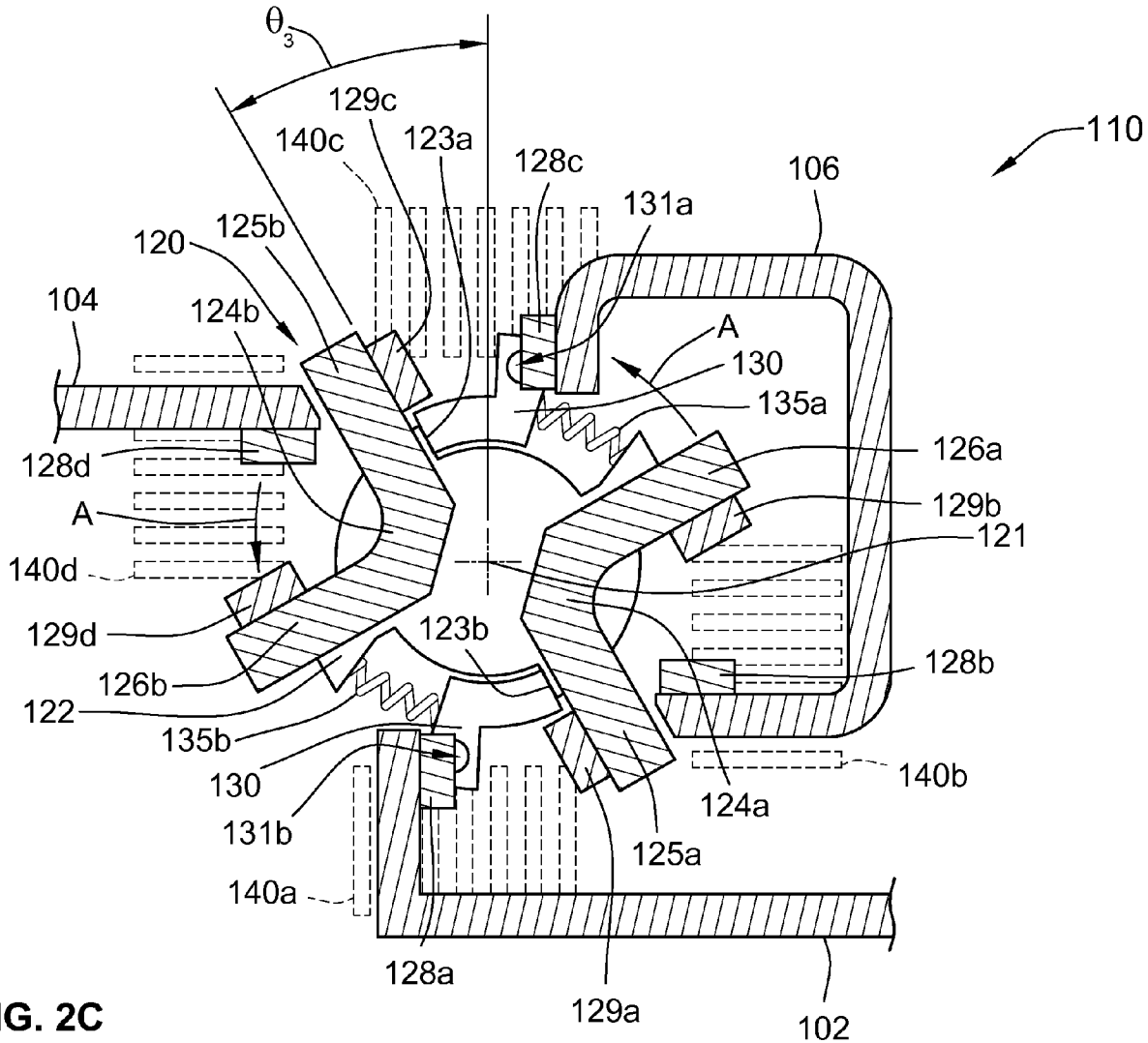
FIG. 2C is a plan view of the interruption unit of FIG. 1 in a tripped position.

Referring generally to FIG. 2A-2C, the two electrically conducting arms 124*a,b* are rigidly coupled to the rotating member 122 such that the arms 124*a,b* rotate in unison with the rotating member 122. The arms 124*a,b* can be made of any electrically conducting material, such as, for example, copper, gold, etc. Each of the arms 124*a,b* has a generally "L" shape defined by angle $\theta_1$ (shown in FIG. 2A). $\theta_1$ is about 90 degrees such that the four pairs of contacts 127*a-d* are positioned about 90 degrees apart.

The first arm 124*a* has a first end 125*a* and a second end 126*a* approximately the same distance from a bend in the first arm 124*a*. Similarly, the second arm 124*b* has a first end 125*b* and a second end 126*b* approximately the same distance from a bend in the second arm 124*b*. The first moveable contact 129*a* is coupled to or integral with the first end 125*a* of the first arm 124*a* and the second moveable contact 129*b* is coupled to or integral with the second end 126*a* of the first arm 124*a*. Similarly, the third moveable contact 129*c* is coupled to or integral with the first end 125*b* of the second arm 124*b* and the fourth moveable contact 129*d* is coupled to or integral with the second end 126*b* of the second arm 124*b*.

The driving member 130 is coupled to the rotating member 122 via two biasing members 135*a,b*, such as, for example, two springs. In FIG. 2A where the driving member 130 is locked in a closed position, the biasing members 135*a,b* are compressed such that the biasing members 135*a,b* bias and/or force the moveable contacts 129*a-d* to abut the corresponding stationary contacts 128*a-d*. The driving member 130 includes a first attachment point 131*a* and a second attachment point 131*b*. The breaker mechanism 150 is coupled to the driving member 130 via the attachment points 131*a,b*. For example, pins (not shown) positioned through the attachment points 131*a,b* can be mechanically coupled to the breaker mechanism 150.

During normal and/or some fault conditions, current flows through the circuit 50 from the source 60 to the load 70. The line terminal 102, the intermediate terminal 106, the load terminal 104, the two electrically conducting arms 124*a,b*, the stationary contacts 128*a-d*, and the moveable contacts 129*a-d* are configured such that electricity can be conducted through the line terminal 102, to the first stationary contact 128*a*, to the first moveable contact 129*a*, through the first arm 124*a*, to the second moveable contact 129*b*, to the second stationary contact 128*b*, through the intermediate terminal 106, to the third stationary contact 128*c*, to the third moveable contact 129*c*, through the second arm 124*b*, to the fourth moveable contact 129*d*, to the fourth stationary contact 128*d*, and through the load terminal 104 when the driving member 130 is in the closed position.

Current flowing through the pairs of contacts 127*a-d* can create a repulsion force between the respective pairs of contacts 127*a-d* that tends to force the respective contact pairs apart. Under rated current, the repulsion force is not strong enough to separate the respective pairs of contacts 127*a-d* and cause current to stop flowing across the pairs of contacts 127*a-d* because the biasing members 135*a,b* bias the respective pairs of contacts 127*a-d* to be pressed together. The present disclosure exploits the natural contact repulsion to assist in rapidly interrupting the current under short circuit conditions as is known in the art. As shown in FIG. 2B, a repulsion force, under short circuit conditions, acting on the interruption unit 110 can cause the four pairs of contacts 127*a-d* to separate a distance 138*a-d*. The repulsion forces cause the rotary arm assembly 120 to rotate in the direction of arrow A by an angle $\theta_2$ (shown in FIG. 2B). It is contemplated that $\theta_2$ can be between about zero and fifteen degrees, which results in the corresponding airgaps 138*a-d* between each of the four contact pairs 127*a-d*.

As shown in FIG. 2B, the interrupter unit 110 is in an intermediate position, which means that the contact pairs 127*a-d* are not completely closed together and in physical contact with one another such as shown in FIG. 2A. Rather, in FIG. 2B, the contact pairs 127*a-d* are separated by a small distance due to the magnetic repulsion forces described above without interrupting the flow of current across the contact pairs 127*a-d*. The driving member 130 is maintained in the closed position as in FIG. 2A; however, as the rotary arm assembly 120 rotates in the direction of arrow A due to the repulsive forces, the rotation causes the biasing members 135*a,b* to further compress.

An equal repulsion force can be generated between each of the pairs of contacts 127*a-d* causing each of the pairs of contacts 127*a-d* to separate an equal distance 138*a-d*. As the pairs of contacts 127*a-d* separate, an arc voltage develops between each of the pairs of contacts 127*a-d* and increases with the separation distance. When a sum of the arc voltages between the pairs of contacts 127*a-d* is greater than an instantaneous voltage of the circuit 50, the arc is extinguished and the current flow is interrupted. The four pairs of contacts 127*a-d* develop a cumulative arc voltage four times greater than a circuit breaker having only one pair of contacts separated by a distance equal to the gaps between the four pairs of contacts 127*a-d*. Similarly, the four pairs of contacts 127*a-d* develop a cumulative arc voltage two times greater than a circuit breaker having two pairs of contacts separated by a distance equal to the gaps between the four pairs of contacts 127*a-d*. Thus, the interruption unit 110 of the present disclosure can interrupt the circuit 50 about four times faster than an interruption unit having one pair of contacts and about two times faster than an interruption unit having two pairs of contacts. The faster interruption of a circuit is desirable as it reduces the peak current (Ip) and energy integral ($I^2t$) characteristics of the circuit breaker 100. This reduction of peak current (Ip) and energy integral ($I^2t$) characteristics and can extend the life of the circuit breaker 100 by reducing the time the internal components of the circuit breaker 100, such as the contacts, are exposed to fault conditions.

Referring to FIGS. 2A and 2C, the driving member 130 is positioned about the rotating member 122 such that the driving member 130 is configured to rotate in the direction of the arrow A about the central axis 121. As shown, the driving member 130 is configured to rotate about the central axis 121 of the rotating member 122 between its closed position (FIG. 2A) and its tripped position (FIG. 2C). In FIG. 2A, the interruption unit 110 is in the closed position where the driving member 130 is locked in place by the breaker mechanism 150 (FIG. 1) such that the driving member 130 is not free to rotate. During non-short circuit conditions of the circuit breaker 100, current flows through the contact pairs 127*a-d* until the breaker mechanism 150 is released. However, in response to the trip unit 160 (FIG. 1) releasing the breaker mechanism 150, the breaker mechanism 150 is configured to urge the driving member 130 from its closed position (FIG. 2A) to its tripped position (FIG. 2C). Switching or rotating the driving member 130 from the closed position (FIG. 2A) to the tripped position (FIG. 2C) in the direction of arrow A causes the driving member 130 to engage or act upon the lips 123*a,b* of the rotating member 122. The engagement of the driving member 130 with the lips 123*a,b* of the rotating member 122 causes the rotary arm assembly 120 to rotate in the direction of arrow A about the central axis 121 of the rotating member 122.

As shown in FIG. 2C, the rotary arm assembly 120 is configured to rotate in the direction of arrow A by an angle $\theta_3$. It is contemplated that $\theta_3$ can be between about 15 and 30 degrees, but should in any implementation be sufficient to cause no electrical current to flow across the airgap between stationary and moveable contacts 128*a-d*, 129*a-d*. Such rotation of the rotary arm assembly 120 through $\theta_3$ causes each of the moveable contacts 129*a-d* to move away from the corresponding stationary contacts 128*a-d*, thereby opening the circuit 50. In the tripped position (FIG. 2C), the driving member 130 is locked in place and the biasing members 135*a,b* are substantially uncompressed. An operator can reset the interruption unit 110 back to the closed position by, for example, mechanically rotating the driving member 130 back to its closed position via a handle (not shown) attached to the breaker mechanism 150.

Referring generally to FIGS. 2A-2C, arc chutes 140*a-d* can optionally be positioned adjacent each of the pairs of contacts 127*a-d* within the housing (not shown) of the circuit breaker 100.

While the stationary contacts 128*a-d* are shown as being separate elements coupled to the respective terminals 102, 104, 106, it is contemplated that the stationary contacts 128*a-d* and the respective terminals 102, 104, 106 are formed from a single piece of material. For example, the line terminal 102 and the first stationary contact 128*a* can be formed from the same piece of material. For another example, the intermediate terminal 106 and the second and the third stationary contacts 128*b,c* can be formed from a single piece of material. For a third example, the load terminal 104 and the fourth stationary contact 128*d* can be formed from the same piece of material.

While the rotating member 122 is shown as having a generally barrel shape, it is contemplated that the rotating member 122 can have other shapes, such as, for example, a square shape, a rectangular shape, a generally "X" shape or cross shape, a generally "T" shape, etc.

While the rotating member 122 is shown as having two lips 123*a,b*, it is contemplated that the rotating member 122 can include only one lip 123*a* or 123*b*, or more than two lips.

While the driving member 130 is illustrated as having a first attachment point 131*a* and a second attachment point 131*b*, it is contemplated that the driving member 130 includes only one attachment point 131*a* or 131*b*, or more than two attachment points.

While the interruption unit 110 is illustrated as having a first biasing member 135*a* and a second biasing member 135*b*, it is contemplated that the interruption unit 110 includes only one biasing member 135*a* or 135*b*, or more than two biasing members.

While $\theta_1$ is illustrated as being about 90 degrees, other angles for $\theta_1$ are contemplated. For example, $\theta_1$ can be 30 degrees, 45 degrees, 60 degrees, 75 degrees, 105 degrees, 135 degrees, 150 degrees, 180 degrees, etc.

For the examples where $\theta_1$ is less than 90 degrees, such as, for example, 45 degrees, one or more additional arms can be coupled to the rotating member 122. The additional arm(s) can include moveable contacts configured to abut additional stationary contacts coupled with additional intermediate terminals. Such additional elements can be arranged such that the interruption unit 110 includes, for example, 6, 8, or more pairs of contacts.

For the examples where $\theta_1$ is greater than 90 degrees, the two arms can be coupled to the rotating member 122 such that the arms are electrically insulated from each other. For example, the arms can be positioned in different planes along the axis of rotation of the rotating member 122. For another example, one of the arms can be bent and/or formed around the other arm.

While the driving member 130 is illustrated as rotating about the central axis 121 of the rotating member 122, it is contemplated that the driving member 130 can rotate about a different axis, such as, for example, a pivot point elsewhere in the circuit breaker 100. It is also contemplated that instead of rotating, the driving member 130 can be a solenoid or other electro-mechanical mechanism configured to act on the rotary arm assembly 120.

It is contemplated that the terminals 102, 104, and 106 can be made with one or more blow-off loops, which can create additional and/or larger repulsive forces between the pairs of contacts 127*a-d* in the interruption unit 110.

While the interruption unit 110 illustrated is for a single pole circuit breaker, it is contemplated that the interruption unit 110 is a building block that can be coupled to one or more additional interruption units that are the same as, or similar to, the interruption unit 110, to form a multi-pole circuit breaker. For example, each of the interruption units includes four pairs of contacts, a respective rotating member, and a respective driving member coupled to the respective rotating members via respective biasing members.

Words of degree, such as "about", "substantially", and the like are used herein in the sense of "at, or nearly at, when given the manufacturing, design, and material tolerances inherent in the stated circumstances" and are used to prevent the unscrupulous infringer from unfairly taking advantage of the invention disclosure where exact or absolute figures are stated as an aid to understanding the invention.

While particular aspects, embodiments, and applications of the present invention have been illustrated and described, it is to be understood that the invention is not limited to the precise construction and compositions disclosed herein and that various modifications, changes, and variations may be apparent from the foregoing descriptions without departing from the spirit and scope of the invention as defined in the appended claims.

What is claimed is:

1. An interrupter unit for a circuit breaker, comprising:

a rotary arm assembly including a rotating member and first and second arms, each of the arms being rigidly coupled to the rotating member such that the arms are configured to rotate in unison with the rotating member about an axis of rotation and such that the first arm does not overlap the second arm about the axis of rotation, each of the arms having a first end and a second end, the first end of the first arm including a first moveable contact, the second end of the first arm including a second moveable contact, the first end of the second arm including a third moveable contact, and the second end of the second arm including a fourth moveable contact;

a line terminal including a first stationary contact that is configured to be electrically connected with the first moveable contact;

an intermediate terminal including a second stationary contact configured to be electrically connected with the second moveable contact and a third stationary contact configured to be electrically connected with the third moveable contact;

a load terminal including a fourth stationary contact configured to be electrically connected with the fourth moveable contact; and a driving member having a closed position and a tripped position, the driving member being coupled to the rotary arm assembly via a biasing member, the biasing member biasing the rotary arm assembly such that the moveable contacts are positioned to electrically couple with the respective stationary contacts in response to the driving member being in the closed position, the driving member being configured to rotate the rotary arm assembly to separate the moveable contacts from the respective stationary contacts such that the moveable contacts are electrically insulated from the stationary contacts in response to the driving member switching from the closed position to the tripped position.

2. The interrupter unit of claim 1, wherein the rotating member includes at least one lip, the driving member being configured to engage the at least one lip of the rotating member to rotate the rotary arm assembly.

3. The interrupter unit of claim 1, wherein the biasing member is a spring, the biasing member being compressed to bias the moveable contacts to abut the respective stationary contacts such that current is conducted through the interrupter unit without arcing.

4. The interrupter unit of claim 1, wherein each of the arms have a generally "L" shape and are positioned such that the moveable contacts are substantially 90 degrees apart.

5. The interrupter unit of claim 1, wherein the rotating member includes an insulating material and the arms include a conducting material.

6. The interrupter unit of claim 1, wherein the moveable contacts are integral with the arms such that the moveable contacts and the arms are formed from a single piece of material.

7. The interrupter unit of claim 1, wherein the driving member is coupled to a breaker mechanism that is configured to switch the driving member from the closed position to the tripped position.

8. The interrupter unit of claim 7, wherein the breaker mechanism is coupled to a trip unit that is configured to release the breaker mechanism such that the breaker mechanism switches the driving member from the closed position to the tripped position.

9. The interrupter unit of claim 1, wherein the axis of rotation does not pass through the first and the second arms.

10. An interrupter unit for a circuit breaker, comprising:

first, second, third, and fourth moveable contacts operatively coupled to a rotating member such that the moveable contacts are configured to rotate in a common plane that is perpendicular to an axis of rotation of the rotating member;

a first stationary contact that is positioned to abut the first moveable contact;

a second stationary contact positioned to abut the second moveable contact;

a third stationary contact positioned to abut the third moveable contact;

a fourth stationary contact positioned to abut the fourth moveable contact; and a driving member having a closed position and a tripped position, the driving member being coupled to the rotating member via at least one biasing member, the at least one biasing member biasing the rotating member such that the moveable contacts are positioned to electrically couple with the respective stationary contacts in response to the driving member being in the closed position, the driving member being configured to rotate the rotating member to separate the moveable contacts from the respective stationary contacts such that the moveable contacts are electrically insulated from the respective stationary contacts in response to the driving member switching from the closed position to the tripped position.

11. The interrupter unit of claim 10, wherein the first, second, third, and fourth moveable contacts are operatively coupled to the rotating member via first and second electrically conducting arms.

12. The interrupter unit of claim 11, further comprising a line terminal, an intermediate terminal, and a load terminal.

13. The interrupter unit of claim 12, wherein the line terminal, the intermediate terminal, the load terminal, the first and second electrically conducting arms, the stationary contacts, and the moveable contacts are configured such that electricity can be conducted through the line terminal, to the first stationary contact, to the first moveable contact, through the first electrically conducting arm, to the second moveable contact, to the second stationary contact, through the intermediate terminal, to the third stationary contact, to the third moveable contact, through the second electrically conducting arm, to the fourth moveable contact, to the fourth stationary contact, and through the load terminal.

14. The interrupter unit of claim 11, wherein the axis of rotation does not pass through the first and the second electrically conducting arms.

15. The interrupter unit of claim 11, wherein each of the electrically conducting arms have a generally "L" shape and are positioned such that the moveable contacts are substantially 90 degrees apart.

16. The interrupter unit of claim 10, wherein the at least one biasing member is compressed when the driving member is in the closed position.

17. The interrupter unit of claim 16, wherein the rotating member is configured to rotate between about zero and fifteen degrees from a closed position while the driving member is in the closed positioned, the rotation of the rotating member causing the at least one biasing member to further compress.

18. The interrupter unit of claim 10, wherein the rotating member is configured to rotate up to about thirty degrees from a closed position in response to the driving member switching from the closed position to the tripped position.

19. A circuit breaker, comprising:

a first interrupter unit, the first interrupter unit including:

four pairs of contacts, each pair including a stationary contact positioned to abut a corresponding moveable contact;

a rotating member, each of the moveable contacts being coupled to the rotating member such that the moveable contacts are configured to rotate in a common plane that is perpendicular to an axis of rotation of the rotating member; and a driving member coupled to the rotating member via a biasing member, the driving member being rotated by a breaker mechanism to cause the moveable contacts to rotate together away from the corresponding stationary contacts about the rotating member.

20. The circuit breaker of claim 19, wherein the rotating member includes two arms, the rotating member being rotatable up to about thirty degrees.

21. The circuit breaker of claim 19, wherein the circuit breaker is a three pole circuit breaker, the circuit breaker further comprising a second interrupter unit and a third interrupter unit, the first, second, and third interrupter units being mechanically coupled together.

22. The interrupter unit of claim 20, wherein the axis of rotation does not pass through the two arms.

23. The circuit breaker of claim 20, wherein each of the two arms has a generally "L" shape and is positioned such that each of the four pairs of contacts are substantially 90 degrees apart.

* * * * *